US008651894B1

(12) United States Patent
Zhang

(10) Patent No.: US 8,651,894 B1
(45) Date of Patent: Feb. 18, 2014

(54) METER SOCKET HAVING A BREAKABLE TAB FOR RETAINING A SLIDING NUT

(75) Inventor: Fan Zhang, Suwanee, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 28 days.

(21) Appl. No.: 13/565,956

(22) Filed: Aug. 3, 2012

(51) Int. Cl.
*H01R 33/945* (2006.01)
*H01R 13/62* (2006.01)

(52) U.S. Cl.
USPC ..... 439/517; 439/301

(58) Field of Classification Search
USPC ..... 439/301–301, 517
See application file for complete search history.

(56) References Cited

U.S. PATENT DOCUMENTS

| | | | | |
|---|---|---|---|---|
| 7,347,722 | B2 | 3/2008 | Montalbo | |
| 7,503,800 | B2 * | 3/2009 | Siglock et al. | 439/517 |
| 7,559,793 | B1 | 7/2009 | Rusch | |
| 7,614,908 | B2 | 11/2009 | Zhang | |
| 8,172,596 | B2 * | 5/2012 | Siebens | 439/301 |

* cited by examiner

*Primary Examiner* — Chandrika Prasad

(57) ABSTRACT

An electric meter socket for connecting electrical conductors thereto includes a meter socket block configured to receive at least one lug assembly. The lug assembly is configured to receive an electrical conductor and may include a lug and sliding nut. The lug includes a slide path that allows the sliding nut to be removed from the lug so an electrical conductor can be placed in the lug for connection to the meter socket. To prevent the sliding nut from sliding out of the lug until an electrical conductor is ready to be connected, the meter socket block includes at least one breakable tab that blocks the slide path, thus retaining the sliding nut within the lug. The breakable tab may be removed when an electrical conductor is ready to be connected. Methods of assembling a meter socket and of connecting electrical conductors thereto are also provided, as are other aspects.

20 Claims, 5 Drawing Sheets

METER SOCKET HAVING A BREAKABLE TAB FOR RETAINING A SLIDING NUT

FIELD

The invention relates generally to electric meter sockets configured to receive electrical conductors.

BACKGROUND

Electric meter sockets commonly have four or more lug assemblies for connecting electrical conductors to the meter socket. A lug assembly typically has a lug, a sliding nut, and a set screw. The sliding nut is configured to slide out of the lug via a slide path to allow an electrical conductor to be placed in the lug for connection to the meter socket. To prevent the sliding nut from sliding out of the lug until an electrical conductor is ready to be connected to the meter socket, which is usually at an installation site, the set screw is typically screwed through the sliding nut and deep into the lug for most, if not all, of the set screw's length until the set screw securely contacts the inside bottom of the lug. This creates a friction fit between the sliding nut and the lug, which holds the sliding nut in place during shipping and handling of the meter socket from the factory to the installation site. However, at the installation site, each of the four or more set screws has to be screwed back out of the lug in order to be able to slide the sliding nut out of the lug to place the electrical conductor therein and then slide the sliding nut back into the lug. This increases installation time and thus labor costs. Therefore, a need exists to shorten the installation time for connecting electrical conductors to meter sockets.

SUMMARY

According to a first aspect, a meter socket is provided that requires less installation time for connecting electrical conductors thereto. The meter socket includes a lug assembly configured to receive an electrical conductor. The lug assembly has a lug and a sliding nut. The lug has a slide path wherein the sliding nut is configured to slide along the slide path. The meter socket also includes a meter socket block configured to receive the lug assembly. The meter socket block has at least one breakable tab configured to align with the slide path to block the sliding nut from sliding out of the lug via the slide path when the lug assembly is received in the meter socket block.

According to another aspect, a method of assembling a meter socket is provided. The method includes forming a meter socket block having at least one lug assembly cavity and at least one breakable tab. The method also includes sliding a sliding nut into a lug having a slide path configured to receive the sliding nut. The sliding nut and lug form a lug assembly configured to receive an electrical conductor. The method further includes attaching the lug assembly to the meter socket block at the lug assembly cavity such that the sliding nut is blocked from sliding out of the lug via the slide path by the at least one breakable tab.

According to yet another aspect, a method of connecting an electrical conductor to a meter socket is provided. The method includes (a) removing a breakable tab located on a meter socket block; sliding a sliding nut out of a lug via a slide path no longer blocked by the breakable tab; placing an electrical conductor in the lug; sliding the sliding nut into the lug via the slide path; and driving a fastener through the sliding nut into the lug until the fastener securely holds the electrical conductor in place.

Still other aspects, features, and advantages of the invention may be readily apparent from the following detailed description wherein a number of exemplary embodiments and implementations are described and illustrated, including the best mode contemplated for carrying out the invention. The invention may also be capable of other and different embodiments, and its several details may be modified in various respects, all without departing from the scope of the invention. Accordingly, the drawings and descriptions are to be regarded as illustrative in nature, and not as restrictive. The drawings are not necessarily drawn to scale. The invention covers all modifications, equivalents, and alternatives falling within the scope of the invention.

DETAILED DESCRIPTION

Reference will now be made in detail to the example embodiments of this disclosure, which are illustrated in the accompanying drawings. Wherever possible, the same reference numbers will be used throughout the drawings to refer to the same or like parts.

The aforementioned problem of time consuming installation when connecting electrical conductors to meter sockets is overcome by embodiments of the invention. In particular, the meter sockets according to embodiments of the invention include lug assemblies that do not require fasteners (e.g., set screws) to be driven deep into a lug to create a friction fit between a sliding nut and the lug in order to prevent the sliding nut from sliding out of the lug during shipping and handling of the meter socket. Embodiments of the invention advantageously retain the sliding nut within the lug without requiring the fastener to create a friction fit. "Fastener" as used herein shall denote any threaded connector operational with a sliding nut and used to secure an electrical conductor to a meter socket. The fastener may then be driven into the sliding nut only as much as is needed to hold the fastener in place, thus reducing installation time, as will be explained in greater detail below with reference to FIGS. 1-9.

Figure 1:
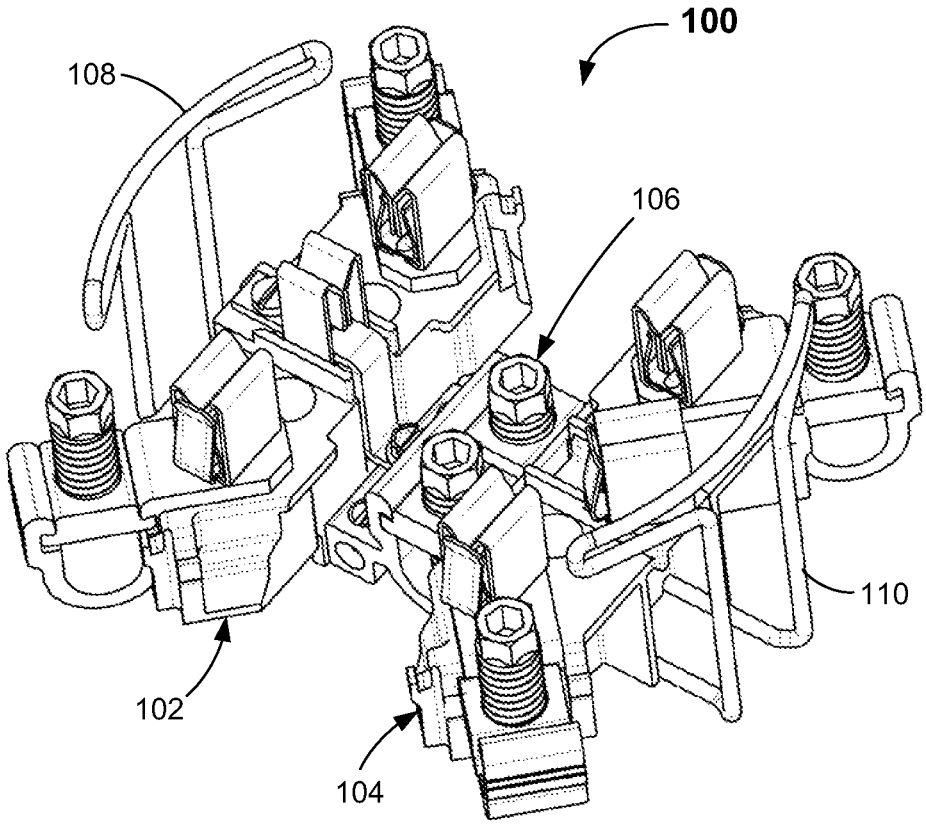
FIG. 1 illustrates a perspective view of an electric meter socket according to embodiments.

FIG. 1 illustrates a meter socket 100 that may be used to connect power from an electric utility company or other source to a residence or other building or structure in accordance with some embodiments of the invention. Meter socket 100 may be configured to receive an electric utility meter (not shown), such as, e.g., a watt-hour type meter, which may be used by, e.g., a utility company to track and accordingly bill for electricity usage. Meter socket 100 includes first and second meter socket block assemblies 102 and 104, a neutral/ground lug assembly (electrical connector) 106, and first and second meter seating bridges 108 and 110, which may be used to help position and/or support an electric meter as it is being installed.

Figure 2:
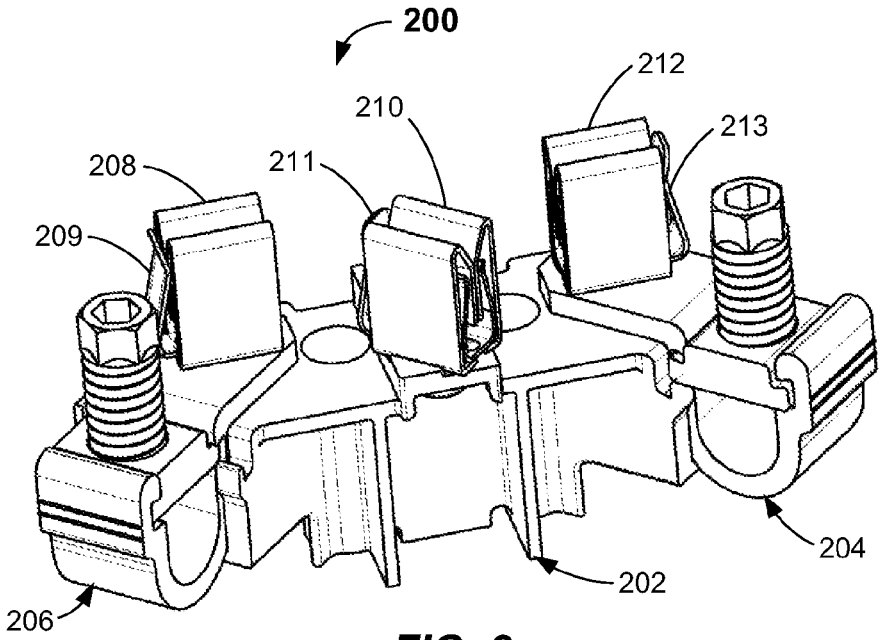
FIG. 2 illustrates a perspective view of a meter socket block assembly according to embodiments.

FIG. 2 illustrates a meter socket block assembly 200 in accordance with one or more embodiments of the invention. Meter socket block assembly 200 may be, for example, meter socket block assembly 102 or 104 of FIG. 1. Meter socket block assembly 200 includes a meter socket block 202, an electrical line lug assembly 204, and an electrical load lug assembly 206. A power line conductor from, e.g., an electric utility company may connect to electrical line lug assembly 204, while a load line conductor from a residence or other building or structure may connect to electrical load lug assembly 206, such as for electrical connection to a load panel, for example. Note that depending on the orientation of meter socket block 202 within a meter socket, lug assembly 204 may alternatively be an electrical load lug assembly, and lug assembly 206 may alternatively be an electrical line lug assembly. Meter socket block assembly 200 may also include meter jaws 208, 210, and 212, which may be configured to receive corresponding prongs of an electric utility meter. The meter jaws 208, 210, and 212 may optionally include spring guides 209, 211, and/or 213 to help position a meter as it is being installed. In some embodiments, the lug assemblies 204 and 206 and meter jaws 208, 210, and 212 may be fastened to meter socket block 202 with fasteners such as, e.g., screws and/or bolts.

Figure 3:
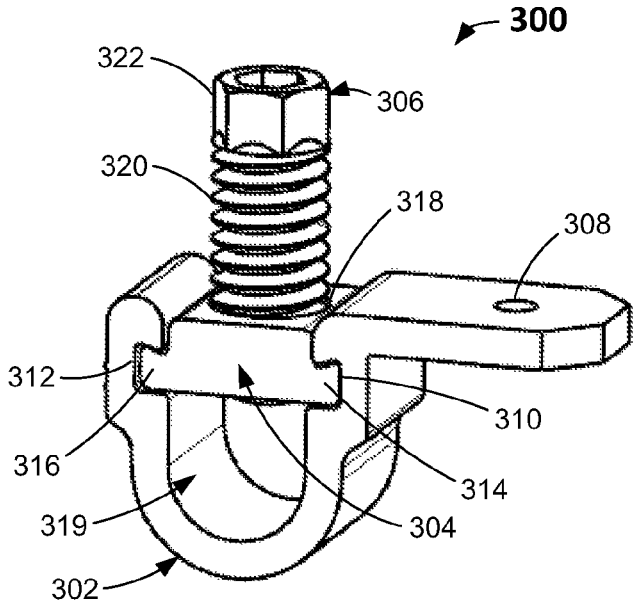
FIG. 3 illustrates a perspective view of a lug assembly according to embodiments.

FIG. 3 illustrates a lug assembly 300 in accordance with one or more embodiments of the invention. Lug assembly 300 may be used to connect an electrical conductor, such as, e.g., a power line, a load line, or a ground/neutral line, to a meter socket. Lug assembly 300 may include a lug 302, a sliding nut 304, and a fastener 306, which may be a set screw or the like. Fastener 306 may be any suitable fastener for electrically contacting and retaining an electrical conductor in lug assembly 300. Lug 302 may have a mounting hole 308 for mounting lug 302 to a meter socket block, such as, e.g., meter socket block 202. Lug 302 may also have a pair of slide paths 310 and 312 positioned on opposite sides of a U-shaped body of the lug 302 for receiving sliding nut 304. Lug 302 may alternatively have other suitable shapes for receiving sliding nut 304 and an electrical conductor therein. In some embodiments, sliding nut 304 may have a pair of opposite side extensions 314 and 316 that are sized to slide along slide paths 310 and 312, respectively. Sliding nut 304 may further have an internally-threaded hole 318 for receiving fastener 306. Fastener 306 may have an externally threaded section 320 configured to mate with internally-threaded hole 318. Fastener 306 may also have a head 322 configured to receive a tool (e.g., screw driver or Allen wrench) for driving fastener 306 into and out of sliding nut 304. Lug assembly 300 may be formed using any suitable materials, such as, e.g., aluminum alloys for lug 302 and aluminum or steel for fastener 306. Lug assembly 300 may be fabricated using any suitable manufacturing process, such as, e.g., machining and cutting of an appropriately configured extrusion.

Figure 4:
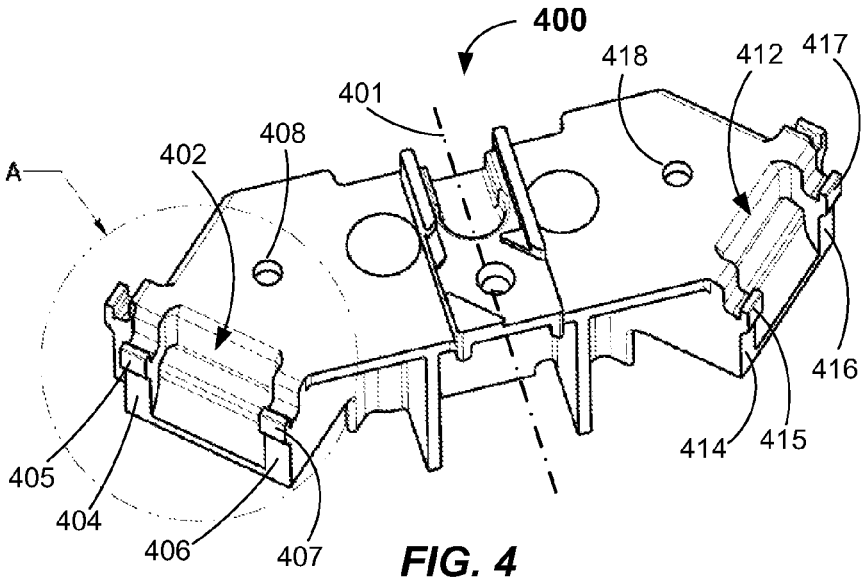
FIG. 4 illustrates a perspective view of a meter block according to embodiments.
Figure 5:
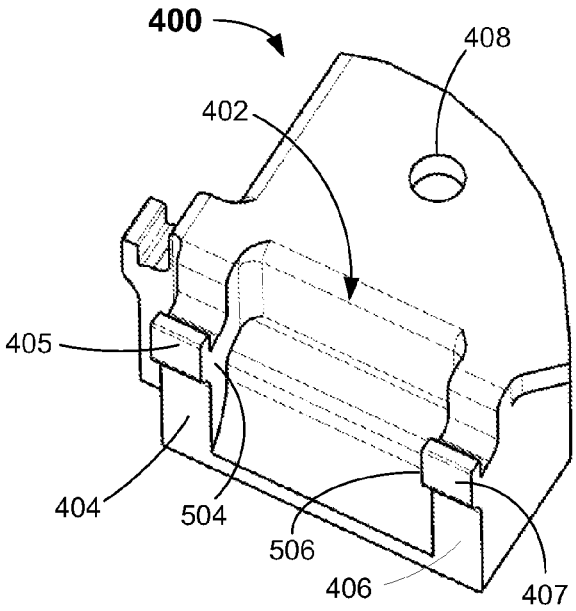
FIG. 5 illustrates an enlarged perspective view of Section A of the meter block of FIG. 4.

As illustrated in FIGS. 4 and 5, a meter socket block 400 may be symmetrically configured along center line 401 in accordance with some embodiments of the invention. Meter socket block 400 may have lug assembly recesses or cavities 402 and 412 respectively disposed on opposite ends of the block 400, wherein each recess or cavity may be configured to receive a lug assembly, such as, e.g., lug assembly 300. Cavity 402 may be bounded on opposite sides by guide ribs 404 and 406, respectively, and cavity 412 may be bounded on opposite sides by guide ribs 414 and 416, respectively. The guide ribs 404, 406 and 414, 416 help position a lug assembly 300 as it is being seated in a lug assembly cavity 402, 412 during the assembly process. The inside walls of the guide ribs (such as, e.g., inside wall 504, 506) may engage the lug assembly received in the cavity 402 to prevent rotational movement of the lug assembly 300 during the assembly process and as an electrical connector is being secured to the lug assembly. Each of guide ribs 404, 406, 414, and 416 may have a respective breakable tab 405, 407, 415, and 417 extending or protruding therefrom. Each of breakable tabs 405, 407, 415, and 417 may be configured to align with and block one side of a slide path of a sliding nut 304 when a lug assembly 300 is seated in cavity 402 or 412. Breakable tabs 405, 407, 415, and 417 may each be any suitable size or shape capable of blocking sliding nut 304 from sliding out of lug assembly 300. In some embodiments, each breakable tab 405, 407, 415, and 417 may be removed or broken away from its respective guide ribs 404, 406, 414, and 416 with a hand tool such as, e.g., a screwdriver, pliers, or other suitable tool. The breakable tab 405, 407, 415, and 417 may be broken away to allow removal of a sliding nut 304 during installation of electrical conductors, as described more fully below. Meter socket block 400 may also have mounting holes 408 and 418 configured and adapted to receive fasteners to mount respective lug assemblies 300 thereto. For example, in some embodiments, mounting holes 408 and/or 418 may align with mounting hole 308 of lug assembly 300. Meter socket block 400 may be formed using any suitable material(s), such as, e.g., thermalset plastics (e.g., a glass fiber reinforced polyester compound) or thermal plastics (e.g., glass filled nylon 6/6), which are suitable for use as an electrical insulator. Meter socket block 400 may be fabricated using any suitable manufacturing process, such as, e.g., injection molding.

Figure 6:
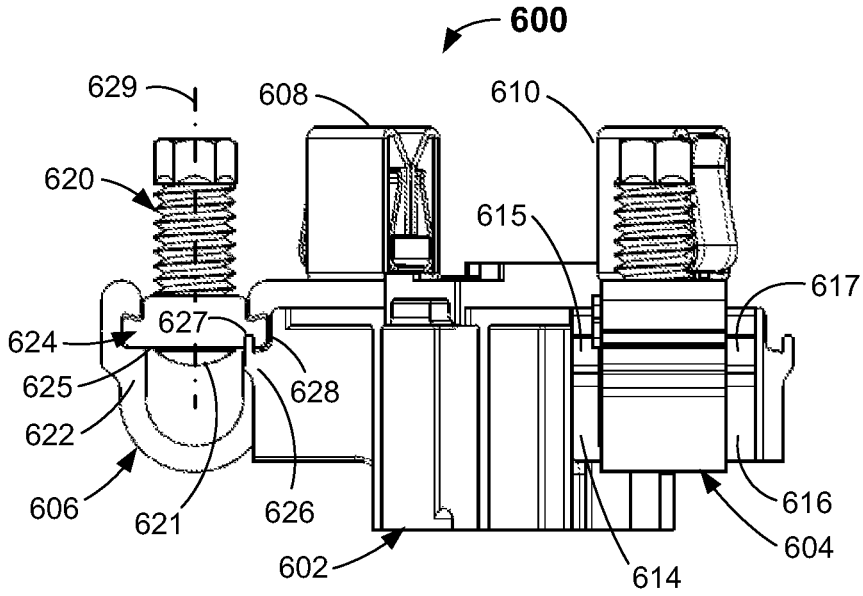
FIG. 6 illustrates a side plan view of a meter socket block assembly according to embodiments.

FIG. 6 illustrates a meter socket block assembly 600 in accordance with one or more embodiments of the invention. Meter socket block assembly 600 may include a meter socket block 602, lug assemblies 604 and 606, and meter jaws 608 and 610. During assembly, lug assembly 604 may be guided into a lug assembly cavity of meter socket block 602 by guide ribs 614 and 616. Lug assembly 606 may be guided into a second lug assembly cavity of meter socket block 602 also by a pair of guide ribs, of which only guide rib 626 is shown. In some embodiments, the guide ribs may butt against the seated lug assembly 604, 606 to help maintain the lug assembly's position as the lug assembly 604, 606 is being fastened to the meter socket block. The guide ribs may additionally or alternatively prevent some or all rotational movement of the lug assembly 604, 606. Breakable tabs may extend or protrude from the guide ribs such as, e.g., (a) breakable tab 615 extending from guide rib 614, (b) breakable tab 617 extending from guide rib 616, and (c) breakable tab 627 extending from guide rib 626. As shown, when lug assembly 606 is seated in meter socket block 602, breakable tab 627 aligns with and blocks one side of slide path 628 of sliding nut 624. This prevents sliding nut 624 from sliding out of lug 622 on that side. A breakable tab may be on the opposite side of tab 627 that may block the opposite side of slide path 628 to prevent sliding nut 624 from sliding out of lug 622 on that opposite side. Note that in some embodiments, sliding nut 624 may be able to slide back and forth somewhat between oppositely positioned tabs of the meter socket block before being blocked by either of the tabs. The tabs of meter socket block assembly 600 may be removed from or broken off of their respective guide ribs (e.g., with a hand tool) when a sliding nut 624 is ready to be slid out of its respective lug. To be clear, only one breakable tab may be provided per sliding nut in some embodiments, thereby allowing the sliding nut to side out only in one direction.

Figure 7:
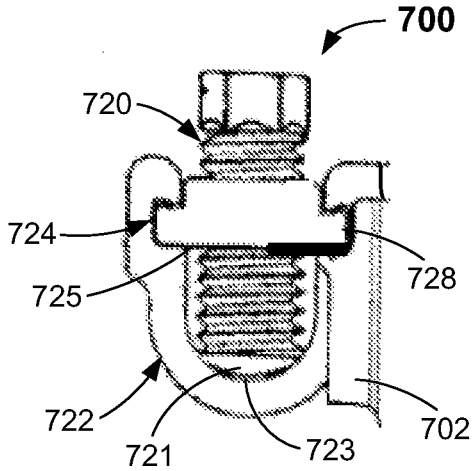
FIG. 7 PRIOR ART
FIG. 7 illustrates a front plan view of a lug assembly configuration according to the prior art.

Because the breakable tabs 615, 617, 627 of the meter socket block 600 prevent a sliding nut from sliding out of a lug, lug fasteners do not need to be driven through the sliding nut deep into the lug to create a friction fit between the sliding nut and the lug, as shown in the known lug assembly configuration of FIG. 7. As shown, lug assembly 700 includes a fastener, which may be a set screw 720, a lug 722, and a sliding nut 724. Lug 722 has a slide path 728 configured to allow sliding nut 724 to slide into and out of lug 722. Note that known meter socket block 702 has no structures to block slide path 728. Accordingly, to prevent sliding nut 724 from sliding out of lug 722 during shipping and handling of meter socket block 702, set screw 720 may be driven deep into lug 722 until bottom surface 721 of set screw 720 securely contacts an inside bottom surface 723 of lug 722. This creates a friction fit between sliding nut 724 and lug 722, which may hold sliding nut 724 in place. However, before an electrical conductor can be connected to lug assembly 700, set screw 720 has to be backed out of the lug 722 until bottom surface 721 is at least near a bottom surface 725 of sliding nut 724. This can be a time consuming process, particular in light of the many electrical service installations requiring six or more lug assemblies to be connected to electrical conductors (e.g., two line connections, two load connections, and two neutral ground connections).

Returning to FIG. 6, meter socket block assembly 600 may be assembled with a lug assembly 606 having fastener 620 inserted into sliding nut 624 such that only a bottom surface 621 of fastener 620 protrudes from a bottom surface 625 of sliding nut 624 in accordance with some embodiments. Alternatively, a lug assembly may be assembled with a fastener, which may be a set screw, driven into a sliding nut such that the set screw may extend beyond a bottom surface of the sliding nut by no more than about one or two turns of the set screw. In other embodiments, a lug assembly may be assembled with a fastener driven into a sliding nut such that no part of the fastener extends beyond the bottom surface of the sliding nut. In still other embodiments, a lug assembly may be assembled with a fastener driven into a sliding nut such that no more than 15% of the fastener's longitudinal length extends or protrudes beyond the bottom surface of the sliding nut (the longitudinal length is measured along the fastener's longitudinal axis, such as, e.g., longitudinal axis 629 of fastener 620). The fastener 620 may be inserted or seated in a sliding nut 624 only as much as is needed for the fastener 620 to remain inserted or seated in the sliding nut 624 during, e.g., shipping and handling of the lug assembly and meter socket block assembly 600, and handling of the sliding nut 624 during installation of an electrical conductor.

Figure 8:
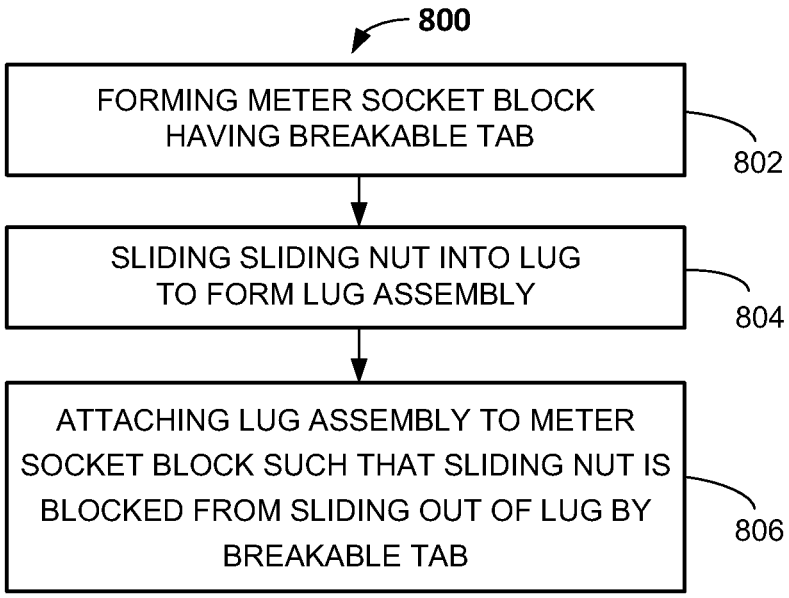
FIG. 8 illustrates a flowchart of a method of assembling a meter socket according to embodiments.

FIG. 8 illustrates a method of assembling a meter socket, such as, e.g., meter socket 100, in accordance with some embodiments of the invention. Method 800 includes, at block 802, forming a meter socket block having at least one lug assembly cavity and at least one breakable tab. The meter socket block may be, e.g., meter socket block 400, and the lug assembly cavity may be, e.g., either of lug assembly cavities 402 or 412. The at least one breakable tab may be any one or more of tabs 405, 407, 415, 417, 615, 617, and/or 627. The meter socket block may be formed with the lug assembly cavity and at least one breakable tab using any suitable material(s), such as, e.g., thermalset plastics (e.g., a glass fiber reinforced polyester compound) or thermal plastics (e.g., glass filled nylon 6/6), which are suitable for use as an electrical insulator. The meter socket block may be formed using any suitable manufacturing process, such as, e.g., injection molding.

At block 804, a sliding nut is slid into a lug via a slide path in the lug. The slide path is configured to receive the sliding nut and may be, e.g., slide paths 310 and 312 of lug 302. The sliding nut and lug form a lug assembly, which is configured to receive an electrical conductor therein. In some embodiments, the sliding nut may have a fastener pre-inserted therein as described above in connection with fastener 620 and sliding nut 624 of lug assembly 606.

At block 806, method 800 includes attaching the lug assembly to the meter socket block at the lug assembly cavity such that the sliding nut is blocked from sliding out of the lug via the slide path by the at least one breakable tab. For example, lug assembly 300 may be attached to meter socket block 400 by seating lug assembly 300 in, e.g., cavity 402, using guide ribs 404 and 406 to properly position lug assembly 300 in the cavity 402. Lug assembly 300 may then be fastened to meter socket block 400 by driving, e.g., a bolt or screw, through mounting hole 308 on lug assembly 300 and aligned mounting hole 408 on block 400. Alternatively, any suitable fastener or fastening method may be used to attach a lug assembly 300 to a meter socket block 400 in accordance with some embodiments of the invention. Upon seating lug assembly 300 in lug assembly cavity 402, breakable tabs 405 and 407 are aligned with and respectively block each side of slide path 310, thus retaining sliding nut 304 within lug 302.

In some embodiments, method 800 may further include attaching a second lug assembly, such as, e.g., lug assembly 204 or 206, to the meter socket block at a second lug assembly cavity of the meter socket block such that a sliding nut of the second lug assembly is blocked from sliding out of a lug of the second lug assembly by at least a second breakable tab of the meter socket block. Method 800 may additionally or alternatively include attaching a neutral/ground lug assembly, such as, e.g., neutral/ground lug assembly 106, to the meter socket block. In some embodiments, method 800 may further include attaching a second meter socket block assembly, such as, e.g., meter socket block assembly 102 or 104, to the neutral/ground lug assembly.

Figure 9:
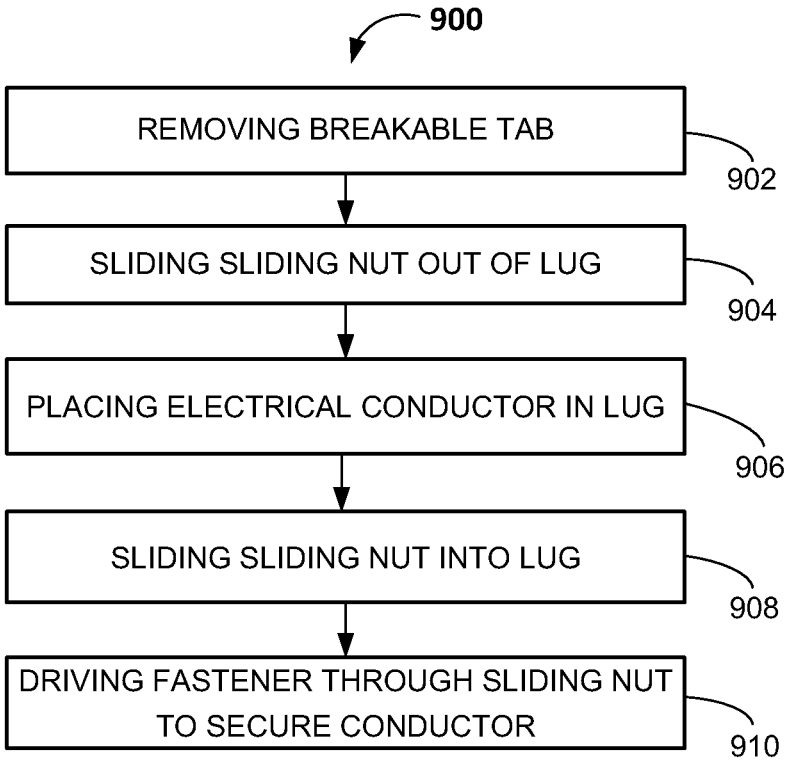
FIG. 9 illustrates a flowchart of a method of connecting an electrical conductor to a meter socket according to embodiments.

FIG. 9 illustrates a method of connecting an electrical conductor to a meter socket, such as, e.g., meter socket 100. At block 902, method 900 includes removing a breakable tab on a meter socket block. The breakable tab may be any one of tabs 405, 407, 415, 417, 615, 617, and/or 627. A breakable tab may be removed or broken off with a hand tool, such as, e.g., a screwdriver, pliers or other suitable tool. In some embodiments, a breakable tab may be removed by hand. Any suitable method or tool may be used to remove a breakable tab. Although a pair of tabs may be used to block opposite sides of a lug assembly slide path (see, e.g., tabs 615 and 617 on opposite side of lug assembly 604 in FIG. 6), only one of the tabs may need to be removed in order to be able to slide out a sliding nut from the lug assembly. Removal of tabs is usually done at an installation site, such as a residence or other building or structure to which an electrical service is to be connected.

At block 904, a sliding nut may be slid out of a lug via the slide path that is no longer blocked by the breakable tab removed at block 902. With the sliding nut removed, the interior of the lug is openly accessible from the top and sides of the lug.

Method 900 further includes at block 906 placing an electrical conductor in the lug. Referring to lug 302 of FIG. 3, for example, the electrical conductor may be placed or held in the interior U-shaped section 319 of lug 302. The portion of the conductor placed in the lug may be uninsulated.

At block 908, the sliding nut is slid back into the lug via the slide path. The sliding nut may or may not have a fastener pre-seated (e.g., screwed or inserted) therein. In embodiments with the fastener pre-seated therein, the fastener may be seated as described above in connection with fastener 620 and sliding nut 624 of lug assembly 606.

At block 910, method 900 includes driving a fastener through the sliding nut and into the lug until the fastener makes electrical contact with and securely holds the electrical conductor in place. In some embodiments, an amount of torque to be applied to the fastener may be specified. The specified torque may be provided by, e.g., the utility company providing the electrical service or the manufacturer of the meter socket. The fastener may be a set screw or any other suitable fastener for electrically contacting and securely holding an electrical conductor in a lug assembly.

It should be understood that the above steps of methods 800 and 900 may be executed or performed in an order or sequence not limited to the order and sequence shown and described. Also, some of the above steps may be executed or performed substantially simultaneously or in parallel where appropriate or desired.

Also, it should be readily appreciated by those persons skilled in the art that the invention is susceptible of broad utility and application. Many embodiments and adaptations of the invention other than those described herein, as well as many variations, modifications, and equivalent arrangements, will be apparent from, or reasonably suggested by, the invention and the foregoing description thereof, without departing from the substance or scope of the present invention. Accordingly, while the invention has been described herein in detail in relation to specific embodiments, it is to be understood that this disclosure is only illustrative and presents examples of the invention and is made merely for purposes of providing a full and enabling disclosure of the invention. This disclosure is not intended to limit the invention to the particular devices, systems or methods disclosed, but, to the contrary, the intention is to cover all modifications, equivalents, and alternatives falling within the scope of the invention.

What is claimed is:

1. A meter socket comprising:

a lug assembly configured to receive an electrical conductor, the lug assembly having a lug and a sliding nut, the lug having a slide path wherein the sliding nut is configured to slide along the slide path; and a meter socket block configured to receive the lug assembly, the meter socket block having at least one breakable tab configured to align with the slide path to block the sliding nut from sliding out of the lug via the slide path when the lug assembly is received in the meter socket block.

2. The meter socket of claim 1 wherein:

the at least one breakable tab comprises two breakable tabs;

the meter socket block is configured to receive the lug assembly between the two breakable tabs; and each of the two breakable tabs is located on an opposite side of the slide path when the lug assembly is received in the meter socket block.

3. The meter socket of claim 1 wherein the least one breakable tab is configured to be removed from the meter socket block with a tool.

4. The meter socket of claim 1 wherein the meter socket block comprises:

a cavity configured to seat the lug assembly; and first and second guide ribs, each of the first and second guide ribs disposed on an opposite side of the cavity, the first and second guide ribs configured to prevent movement of the lug assembly when the lug assembly is received in the meter socket block.

5. The meter socket of claim 4 wherein the least one breakable tab extends from the first or second guide rib.

6. The meter socket of claim 1 wherein:

the lug assembly has a fastener configured to be threadingly received in the sliding nut;

the fastener has a head and a threaded section, the threaded section having a bottom side opposite the head; and the fastener is threadingly received in the sliding nut such that the bottom side of the threaded section does not extend beyond the sliding nut by more than one or two turns of the set screw.

7. The meter socket of claim 1 further comprising a neutral/ground lug assembly attached to the meter socket block.

8. The meter socket of claim 7 further comprising a second meter socket block assembly attached to the neutral/ground lug assembly, the second meter socket block assembly comprising a second meter socket block and at least one lug assembly attached to the second meter socket block.

9. A method of assembling a meter socket, the method comprising:

forming a meter socket block having at least one lug assembly cavity and at least one breakable tab;

sliding a sliding nut into a lug having a slide path configured to receive the sliding nut, the sliding nut and lug forming a lug assembly configured to receive an electrical conductor; and attaching the lug assembly to the meter socket block at the lug assembly cavity such that the sliding nut is blocked from sliding out of the lug via the slide path by the at least one breakable tab.

10. The method of claim 9 wherein the forming a meter socket block further comprises forming a meter socket block having a pair of guide ribs, each of the pair of guide ribs disposed on an opposite side of the at least one lug assembly cavity.

11. The method of claim 9 wherein the attaching the lug assembly comprises:

seating the lug assembly in the lug assembly cavity between a pair of guide ribs disposed on the meter socket block; and fastening the lug assembly to the meter socket block via mounting holes aligned in the lug assembly and the meter socket block.

12. The method of claim 9 further comprising inserting a fastener into a first side of the sliding nut such that the fastener does not extend beyond a second opposite side of the sliding nut.

13. The method of claim 9 further comprising inserting a fastener into a first side of the sliding nut such that the fastener does not extend beyond a second opposite side of the sliding nut by more than 15% of a longitudinal length of the fastener.

14. The method of claim 9 further comprising attaching a second lug assembly to the meter socket block at a second lug assembly cavity of the meter socket block such that a sliding nut of the second lug assembly is blocked from sliding out of a lug of the second lug assembly by at least a second breakable tab of the meter socket block.

15. The method of claim 9 further comprising attaching a neutral/ground lug assembly to the meter socket block.

16. The method of claim 15 further comprising attaching a second meter socket block assembly to the neutral/ground lug assembly, wherein the second meter socket block assembly comprises a second meter socket block and at least one lug assembly attached to the second meter socket block.

17. A method of connecting an electrical conductor to a meter socket, the method comprising:

removing a breakable tab located on a meter socket block;

sliding a sliding nut out of a lug via a slide path no longer blocked by the breakable tab;

placing an electrical conductor in the lug;

sliding the sliding nut into the lug via the slide path; and driving a fastener through the sliding nut into the lug until the fastener securely holds the electrical conductor in place.

18. The method of claim 17 wherein the removing a breakable tab comprises removing one of first and second breakable tabs located on the meter socket block, wherein a lug assembly is disposed between the first and second breakable tabs, and a first side of a slide path of the lug assembly is blocked by the first breakable tab and a second side of the slide path is blocked by the second breakable tab.

19. The method of claim 17 wherein the removing a breakable tab comprises using a screwdriver or pliers to remove the breakable tab.

20. The method of claim 17 wherein the driving a fastener comprises screwing a set screw through the sliding nut into the lug until the set screw electrically contacts and securely holds the electrical conductor in place.

* * * * *